US005836782A

United States Patent [19]

Odley et al.

[11] Patent Number: 5,836,782

[45] Date of Patent: Nov. 17, 1998

[54] INSULATION DISPLACEMENT CONNECTOR

[75] Inventors: Richard Austin Odley, West Midlands; Martin Hebenstreit, Gwynedd, both of United Kingdom

[73] Assignee: Austin Taylor Communications Limited, North Wales, United Kingdom

[21] Appl. No.: 765,570

[22] PCT Filed: Jul. 13, 1995

[86] PCT No.: PCT/GB95/01661

§ 371 Date: May 27, 1997

§ 102(e) Date: May 27, 1997

[87] PCT Pub. No.: WO96/02957

PCT Pub. Date: Feb. 1, 1996

[30] Foreign Application Priority Data

Jul. 13, 1994 [GB] United Kingdom ..... 9414179

[51] Int. Cl.[6] ..... H01R 4/24

[52] U.S. Cl. ..... 439/397; 439/395

[58] Field of Search ..... 439/395, 397, 439/404, 405

[56] References Cited

U.S. PATENT DOCUMENTS 4,448,472 5/1984 Hardesty .

5,269,700 12/1993 Mitra ..... 439/395

5,447,449 9/1995 Kaneko ..... 439/397

FOREIGN PATENT DOCUMENTS

A 0 383 135 of 1990 European Pat. Off. .

U 88 04 388 of 1988 Germany .

A 92 08255 of 1992 WIPO .

*Primary Examiner*—Neil Abrams

*Assistant Examiner*—Brian J. Biggi

*Attorney, Agent, or Firm*—Salter & Michaelson

[57] ABSTRACT

An electrical connector for forming an electrical connection with wires and particularly insulated wires. The connector comprises a connector element having first and second portions (2) with a slot for accepting a wire therebetween. In a preferred embodiment of the invention, the first and second portions are substantially perpendicular and present a stepped slot to a wire that is inserted. The angle between the wire and the first or second portions is in the range 5° to 85° and is typically 45°. When an insulated wire is inserted into the slot, the insulation (8) is penetrated to enable the connector element to establish electrical contact with the conductor (6) of the wire.

7 Claims, 3 Drawing Sheets

INSULATION DISPLACEMENT CONNECTOR

The present invention relates to a connector for forming an electrical connection with wires, including those covered in insulation. Such connectors are commonly mounted in an array within a housing of insulating material. The present invention relates also to the design of connecting blocks for retaining the connector elements, and controlling their movements.

A number of proposals and orientations for such insulation displacement connectors (IDCs) are known. All these proposals suffer from one or more of the disadvantages as described below.

IDCs commonly comprise a cantilevered split beam, whose narrow, slotted portion is dimensioned to be smaller than the diameter of the smallest wire to be terminated therein. At the upper end of the slot, there commonly exists a tapered section of slot which acts as a guide for an incoming wire. On insertion of a wire, any insulation is intended to be cut by the sides of this tapered section of the slot. Commonly, the narrow portion of the slot cuts into the wire forming an airtight joint between the wire conductor and both of the IDC slot sides.

1. Flat IDC at approximately 90° to the wire, movement of the two IDC forks forming the sides of the slot is restricted to one plane, tending to force the forks apart, widening the slot. However, it is noted that deflection is inversely proportional to the cube of the spring thickness. In this deflection mode, the thickness should be taken as the width of each IDC fork. The result is often an extremely stiff action with negligible widening of the slot when a wire is inserted.

Such an arrangement is necessarily limited in the range of wire diameters which may be conveniently terminated if all diameters of wire are cut to essentially the same depth by the stiff slot sides. Also, since the slot impinges onto the wire in two places which are opposite to one another, and the profile of copper wire cut out by each IDC fork is rectangular in section, serious weakening of the wire in the IDC region is likely to be encountered, with an increased risk of wire shearing.

2. Flat IDC at approximately 45° to the wire.

When a copper wire is inserted into the slot of a flat IDC held at 45° to the wire, movement of the two IDC forks forming the sides of the slot occurs in torsional mode, tending to force the forks apart and thus widening the slot.

It is noted that the force exerted on the wire by such IDC forks is directly proportional to the angle of displacement. Such an arrangement would therefore be suitable for terminating a wide range of wire diameters, since the slot dimension would change to correspond with the gauge of wire inserted.

This feature would depend for success on the presence of sharp edges on the IDC forks and it is noted that only one of the two corners of the IDC forks presented to the wire would have the sharp punching burr known to be beneficial for successful IDC connections. A risk of adverse consequences for contact reliability therefore exists.

When shapes such as those required for IDC slot formation are punched from sheet metal, invariably the side from which the metal is punched is left with a blunt, rounded corner. Also, the opposite side of the sheet is left sharp where the punching tool emerged through the slot. For IDC applications it is highly desirable to make use of these sharp edges in order to produce an IDC of reduced insertion force and high reliability.

When the connectors are mounted in an array the array usually consists of parallel pairs of forks. Consequently a capacitance exists between adjacent connectors in the array. This is known to cause problems, particularly at high operational frequencies of the order 100 MHz when capacitive effects are significant. 3. Bent IDC with each IDC fork at approximately 45° to the wire, movement of the two IDC forks forming the sides of the slot would tend to occur, forcing the forks apart and thus widening the slot.

However, with this arrangement the two points of contact between the IDC forks and the wire are opposite one another, and not displaced along the length of the wire. There is therefore a significant risk of wire fracture at the IDC joint.

The present invention alleviates all of these disadvantages of each of the foregoing.

According to the invention there is provided an electrically conductive connector element having first and second portions with a slot for receiving a wire therebetween, the first portion lying in a plane at an angle to the plane of the second portion characterised in that at least a part of the first or second portion lies in the plane of the other portion, the first and second portions overlapping in a direction transverse to the direction in which the wire, in operation, extends through the slot.

According to the invention there is further provided an electrical connector comprising an electrically insulated housing and a connector element of the invention.

Preferably the planes of the first and second portions are at an angle of substantially 90°. One or more corners or edges of the first and second portions may be sharp so that when a wire is inserted into the slot the edges cut into the wire, and possibly also through any insulation on the wire, to form an airtight joint between the wire and the sharp edges of the slot. Preferably any such sharp edges or contact points provided on either portion lie in the plane of one of the first or second portions.

Preferably two such contact points are provided, one on each of the first and second portions.

When a wire is inserted into the slot the first and second portions of the connector element are forced apart, thus widening the slot. Consequently the connector element is capable of accepting wires with a wide range of diameters.

Two or more connector elements may be provided to accept a wire whereby the connector elements are arranged in series with adjacent connector elements having progressively narrower slots. Preferably two connector elements are arranged in this way. This type of arrangement is capable of accepting a wider range of wire diameters than a single connector element.

According to the invention there is further provided an electrical connector comprising a plurality of said connector elements.

The electrical connector may receive a plurality of wires and establish electrical contact therewith. Preferably the connector elements of the said plurality are arranged in parallel whereby first and second portions of adjacent connector elements are substantially perpendicular.

With this arrangement the capacitance and inductance between adjacent connector elements of the said plurality is kept to a minimum. This is particularly important for high frequency applications since capacitive and inductive effects and the associated problems increase with frequency.

The invention will now be described further by way of example only and with reference to the accompanying drawings in which.

Figure 1:
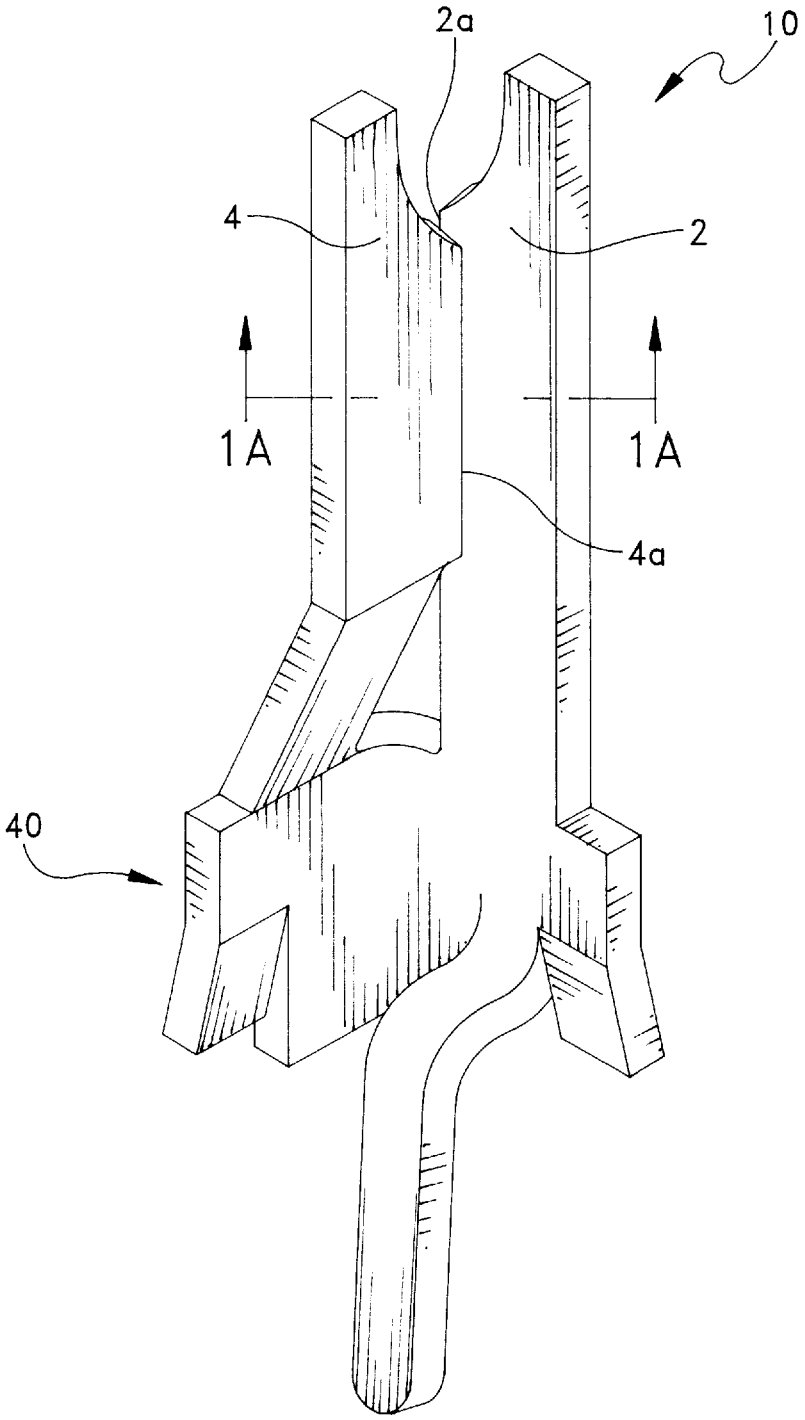
FIG. 1 is a perspective view of a preferred embodiment of the electrical connector of the present invention.
Figure 1A:
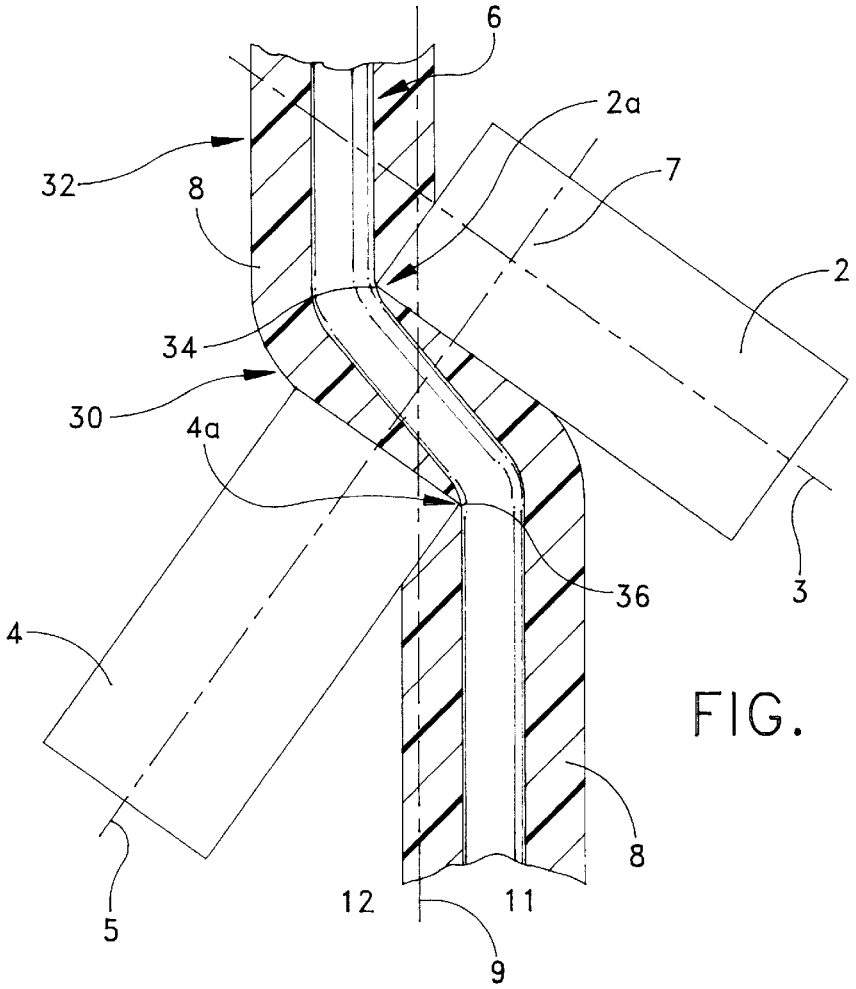
FIG. 1A is a cross-sectional view of the electrical connector of the present invention, taken along line 1—1 of FIG. 1, showing the electrical connector in use.
Figure 2:
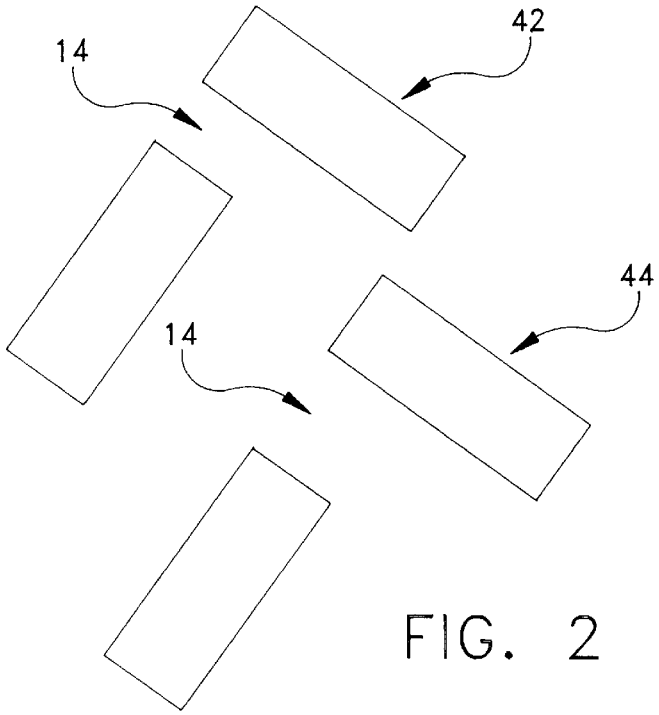
FIG. 2 is a schematic plan view of two connector elements of the invention arranged for accepting a wide range of wire diameters.
Figure 3:
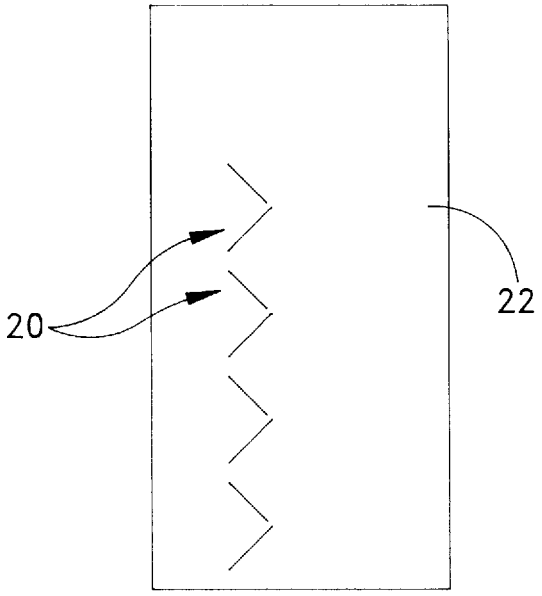
FIG. 3 is a schematic plan view of an electrical connector comprising an array of connector elements in accordance with the invention.

Referring now to the drawings, the electrical connector of the present invention is illustrated and generally indicated at 10 in FIGS. 1–3. The electrical connector 10 comprises a first element 2, generally disposed in a plane 3 and including a contact point 2*a* and a second element 4, generally disposed in a plane 5 and including a contact point 4*a*. First element 2 and second element 4 are arranged to form a passage 30 therebetween. As shown in FIG. 1A, first element 2 and second element 4 are disposed such that the planes 3 and 5 in which elements 2 and 4 lie, respectively, intersect at a point 7. In the preferred embodiment, planes 3 and 5 are perpendicular to each other. Also shown in FIG. 1A, is a line 9 which defines a central axis of the electrical connector 10. First element 2 is substantially disposed on a first side 11 of the central axis 9 and second element 4 is substantially disposed on a second side 12 of central axis 9. However, first and second elements 2 and 4 are arranged such that contact point 2*a* of first element 2 is disposed on the second side 12 of central axis 9 and contact point 4*a* of second element 4 is disposed on the first side 11 of central axis 9. Therefore, when a wire 32 comprising a conductor 6 and insulation 8, is inserted into passage 30, sharp edges of contact points 2*a* and 4*a* penetrate insulation 8 of wire 32 and engage conductor 6, thereby forming an electrical contact with the wire 32. The arrangement of the first and second elements 2 and 4 cause contact points 2*a* and 4*a* to contact wire 32 at locations 34 and 36 along wire 32, where locations 34 and 36 are displaced from each other along the length of wire 32. This causes wire 32 to be deformed into the "S" shape shown in FIG. 1A. This deformation of wire 32 increases the pressure of contact points 2*a* and 4*a* at locations 34 and 36, respectively, thereby securing wire 32 within electrical connector 10.

First element 2, second element 4 and passage 30 may have any suitable shape or dimension and are typically interconnected at a region 40 below the passage 30. The electrical connector 10 is typically housed in and braced by an insulating material such as a plastic moulding. Thus the described embodiment comprises a bent IDC with substantially perpendicular IDC elements 2 and 4 held at typically 45° to the wire, though the angle between the wire and one of the IDC elements 2 and 4 may be in the range 5° to 85°. The IDC includes a stepped slot arrangement which brings a number of benefits:

i) On insertion of a wire, movement of the two IDC forks forming the sides of the passage 30 occurs, tending to force the elements 2 and 4 apart and this widening the passage 30. This arrangement is therefore suitable for terminating a wide range of wire diameters, since the passage 30 dimension increases in response to insertion of a thicker wire.

ii) The two contact points 2*a* and 4*a* between the IDC elements 2 and 4 and wire are not opposite one another, but displaced along the length of the wire. The risk of wire fracture at the IDC joint is therefore significantly reduced.

iii) The natural tendency of the wire to take the straightest possible route within the IDC is used to draw the wire across the contact points 2*a* and 4*a* of the IDC.

iv) Both contact points 2*a* and 4*a* of the IDC elements 2 and 4 presented to the wire have a sharp punching burr known to be beneficial for successful IDC connections.

v) As the movements of each IDC elements 2 and 4 in response to the insertion of a wire are in the same direction, the two contact points 2*a* and 4*a* of the IDC elements 2 and 4 are maintained substantially parallel to one another in the presence of a first inserted wire. This design is therefore suitable for the termination of a plurality of wires in each IDC passage.

FIG. 2 shows an embodiment of the invention comprising two electrical connector 42 and 44 arranged to accept a wide range of wire diameters. Typically the passage 14 of electrical connector 42 is approximately 0.3 mm whereas the passage 16 of electrical connector 44 of the order 0.6 mm. In use a wire is pushed down between the two passages 14 and 16 and depending on the diameter of the wire it will connect securely both mechanically and electrically to the electrical connector 42 and/or the electrical connector 44. When a small diameter wire is inserted into this two connector arrangement the wire will establish electrical contact with the electrical connector 42. The electrical connector 44 may make little or no contribution to the connection of the wire. Alternatively when a larger diameter wire is inserted, electrical contact is established with both electrical connector 42 and 44. In this case the mechanical contact between the wire and electrical connector 44 is likely to be secure whereas there may be a risk of shearing in the region of the wire near electrical connector 42 due to the narrow slot weakening the wire.

Figure 4:
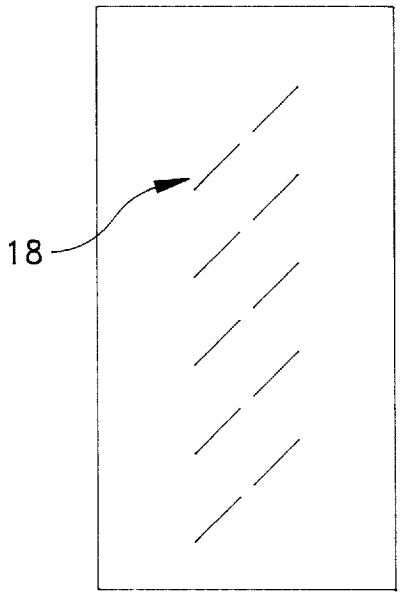
FIG. 4 (PRIOR ART)
FIG. 4 is a schematic plan view of a prior art array of insulation displacement connectors.

FIG. 4 shows the parallel arrangement of IDC connectors 18 in a known type of electrical connector. With this arrangement adjacent electrical connector behave as capacitors which is undesirable, particularly in high frequency applications in which capacitive effects are increased.

This problem is minimised by the arrangement of electrical connector 20 in an electrical connector 22 in accordance with the invention as shown in FIG. 3. With this arrangement the elements of adjacent electrical connector are substantially perpendicular which results in a lower capacitance than with the known arrangement of FIG. 4.

Thus, in a preferred embodiment of the invention an electrical connector comprises one or more electrical connector elements disposed in a housing of electrically insulating material. Each connector is stamped from a piece of metal to form two elements arranged in respective planes to form a stepped passage therebetween, and having cantilever and torsional properties. The passage is sufficiently long to accept a plurality of conductors terminated simultaneously, and is suitable for the termination of a wide range of wire gauges.

When a wire, which may be insulated, is pushed into the passage along a plane which approximately bisects the angle between the planes of the elements, the sharp edges presented to the wire by each arm cut the insulation to make electrical contact with the conductor beneath.

It will be appreciated that the present invention is not intended to be restricted to the details of the above embodiments which are described by way of example only.

We claim:

1. An electrical connector assembly comprising two or more connectors, each having first and second elements with a passage for receiving a wire therebetween, the first element lying in a first plane and the second element lying in a second plane, the first and second planes intersecting each other, wherein at least a part of the first or second element lies in the plane of the other element, the first and second elements overlapping in a direction transverse to the direction in which the wire, in operation, extends through the passage, whereby the connectors are arranged in series and whereby a passage size of each connector becomes narrower along the series.

2. An electrical connector comprising:

first and second spaced elements arranged to define a passage therebetween for receiving and retaining a wire, said first element lying in a first plane and including a first contact point and said second element lying in a second plane and including a second contact point, said first and second planes intersecting each other;

wherein said first element is substantially disposed on a first side of a central axis of said electrical connector and said second element is substantially disposed on a second side of said central axis of said electrical connector, and wherein said first contact point of said first element is disposed on said second side of said central axis and said second contact point is disposed on said first side of said central axis.

3. The electrical connector of claim 2, wherein said first contact point engages said wire at a first location along said wire and said second contact point engages said wire at a second location along said wire, said first and second locations being displaced from each other along a length of said wire.

4. The electrical connector of claim 2, wherein said first and second planes are perpendicular to each other.

5. The electrical connector of claim 2, wherein said first and second contact points include sharp edges for piercing an insulation of said wire and establishing electrical contact with said wire.

6. The electrical connector of claim 2, wherein said first and second elements are movable with respect to each other to adapt a width of said passage for receiving wires of a variety of gauges.

7. An electrical connector element comprising:

a number of electrical connectors arranged in a row, each of said number of electrical connectors comprising:

first and second spaced elements arranged to define a passage therebetween for receiving and retaining a wire, said passage having a width, said first element lying in a first plane and including a first contact point and said second element lying in a second plane and including a second contact point, said first and second planes intersecting each other;

wherein said first element is substantially disposed on a first side of a central axis of said electrical connector and said second element is substantially disposed on a second side of said central axis of said electrical connector, and wherein said first contact point of said first element is disposed on said second side of said central axis and said second contact point is disposed on said first side of said center line; and wherein said first contact point engages said wire at a first location along said wire and said second contact point engages said wire at a second location along said wire, said first and second locations being displaced from each other along a length of said wire;

wherein passages of adjacent electrical connectors in said row have widths which are different from each other.

* * * * *